US008796573B2

(12) United States Patent
Koo

(10) Patent No.: US 8,796,573 B2
(45) Date of Patent: Aug. 5, 2014

(54) CIRCUIT BREAKER

(75) Inventor: Bon Geun Koo, Cheongju (KR)

(73) Assignee: LSIS Co., Ltd., Anyang, Gyeonggi-Do (KR)

( * ) Notice: Subject to any disclaimer, the term of this patent is extended or adjusted under 35 U.S.C. 154(b) by 287 days.

(21) Appl. No.: 13/364,220

(22) Filed: Feb. 1, 2012

(65) Prior Publication Data

US 2012/0211339 A1 Aug. 23, 2012

(30) Foreign Application Priority Data

Feb. 22, 2011 (KR) ..... 20-2011-0001490 U

(51) Int. Cl.

| | |
|---|---|
| ***H01H 1/52*** | (2006.01) |
| ***H01H 3/20*** | (2006.01) |
| ***H01H 9/00*** | (2006.01) |
| ***H01H 71/02*** | (2006.01) |
| ***H01H 83/20*** | (2006.01) |
| ***H01H 71/12*** | (2006.01) |
| *H01H 83/12* | (2006.01) |

(52) U.S. Cl.

CPC ..... *H01H 71/0271* (2013.01); *H01H 83/20* (2013.01); *H01H 71/128* (2013.01); *H01H 2071/0278* (2013.01); *H01H 71/0228* (2013.01); *H01H 83/12* (2013.01)

USPC ..... 200/318

(58) Field of Classification Search

CPC . H01H 71/40; H01H 71/0207; H01H 71/522; H01H 71/24; H01H 71/505; H01H 71/526; H01H 1/2058; H01H 71/126; H01H 9/22

USPC ..... 200/318

See application file for complete search history.

(56) References Cited

U.S. PATENT DOCUMENTS

| | | | | |
|---|---|---|---|---|
| 4,246,558 | A | 1/1981 | Zubaty et al. | |
| 4,806,893 | A | 2/1989 | Castonguay et al. | |
| 6,489,577 | B2 * | 12/2002 | Kurata | 200/331 |

FOREIGN PATENT DOCUMENTS

| | | |
|---|---|---|
| CN | 1622248 | 6/2005 |
| CN | 101038833 | 9/2007 |
| JP | 6-111704 | 4/1994 |
| JP | 6-111705 | 4/1994 |
| JP | 6-333489 | 12/1994 |
| JP | 10-188770 | 7/1998 |
| JP | 10-321113 | 12/1998 |
| JP | 2000-003656 | 1/2000 |

(Continued)

OTHER PUBLICATIONS

European Patent Office Application Serial No. 12155546.0, Search Report dated Oct. 22, 2012, 7 pages.

Japan Patent Office Application Serial No. 2012-024976, Office Action dated Apr. 9, 2013, 2 pages.

(Continued)

*Primary Examiner* — Renee S Luebke

*Assistant Examiner* — Lheiren Mae Caroc

(74) *Attorney, Agent, or Firm* — Lee, Hong, Degerman, Kang & Waimey

(57) ABSTRACT

A circuit breaker includes a main case; a switching mechanism accommodated in the main case, and having a mechanical part for opening and closing a circuit; a trip mechanism configured to trigger the switching mechanism to a circuit interrupting position upon detection of an abnormal current on a circuit; and an external device detachably mounted to the main case, wherein the circuit breaker includes an interrupting means configured to interrupt the switching mechanism by contacting at least a part of the external device when the external device is mounted to the main case.

5 Claims, 8 Drawing Sheets

(56) References Cited

FOREIGN PATENT DOCUMENTS

| | | |
|---|---|---|
| JP | 2001-060429 | 3/2001 |
| JP | 2007-280777 | 10/2007 |
| JP | 2007-335275 | 12/2007 |
| JP | 2011-023372 | 2/2011 |
| WO | 2004/047137 | 6/2004 |

OTHER PUBLICATIONS

The State Intellectual Property Office of the People's Republic of China Application Serial No. 201210047039.X, Office Action dated Dec. 30, 2013, 7 pages.
Japan Patent Office Application Serial No. 2012-024976, Office Action dated Oct. 29, 2013, 3 pages.

* cited by examiner

CIRCUIT BREAKER

CROSS-REFERENCE TO RELATED APPLICATION

Pursuant to 35 U.S.C. §119(a), this application claims the benefit of earlier filing date and right of priority to Korean Utility Model Application No. 20-2011-0001490, filed on Feb. 22, 2011, the contents of which are hereby incorporated by reference herein in their entireties.

BACKGROUND OF THE INVENTION

1. Field of the Invention

The present invention relates to a circuit breaker, and particularly, to a circuit breaker capable of interrupting a circuit in the occurrence of an over-current or an abnormal current.

2. Background of the Invention

Generally, a circuit breaker is installed in a distribution board among distribution equipment such as factories and buildings. In no load state, the circuit breaker serves as a switching apparatus for supplying power to a load side or interrupting power supplied to the load side. In a load state, the circuit breaker serves as a breaker for interrupting power supplied to a load side from a power side in the occurrence of an over-current on a circuit.

The circuit breaker is configured to have variable structures due to a difference of a frame size, the number of poles, an operation manner, etc. Generally, the circuit breaker includes basic components such as a mold case, a contactor, a trip mechanism, a switching mechanism extinguishing device, a terminal, etc.

FIG. 1 is a perspective view of a circuit breaker in accordance with the conventional art, FIG. 2 is a disassembled perspective view of the circuit breaker of FIG. 1, FIG. 3 is an enlargement view of a switching mechanism, and FIGS. 4A and 4B are schematic views for explaining an operation of the switching mechanism.

In an 'on' state of a circuit breaker implemented by using a switching handle 15, the circuit breaker may be tripped by a trip button 3 as follows. As shown in the arrow of FIG. 4A, a head portion of the trip button 3 is pressed. Then, the trip button 3 penetratingly-installed at an installation hole 2 of an auxiliary cover 5 is lowered, thereby pressing an inclined side 7*a* of a bracket 7 of the switching mechanism.

As a result, the bracket 7 hinge-coupled to a load side end of a side plate 8 is clockwise rotated about a hinge shaft 6*a*, thereby being in a state shown in FIG. 4B. A latch 10 held by a latch holder 9 is released by a restoration force of a main spring (not shown), and is counterclockwise rotated about a rotation center 12. This causes a movable contactor 13 installed at a main shaft 16 to be separated from a fixed contactor 14 by interwork of a link mechanism. As a result, the circuit breaker is tripped.

The circuit breaker is provided with an external device at a body. The external device may include an auxiliary device such as an auxiliary switch or an alarm switch, an under voltage trip device (UVT) which operates when a voltage of a circuit becomes low, a shunt trip coil for remotely tripping the circuit breaker, etc.

The external devices should be mounted to the circuit breaker in an 'off' state or a trip state. If a user performs an operation to mount the external device to the circuit breaker in an 'on' state by mistake, accidents may occur and the bracket may be damaged due to interference between a mechanical part of the bracket and the external device.

SUMMARY OF THE INVENTION

Therefore, an aspect of the detailed description is to provide a circuit breaker capable of being automatically turned off once an external device is coupled thereto even in an 'on' state.

To achieve these and other advantages and in accordance with the purpose of this specification, as embodied and broadly described herein, there is provided a circuit breaker, comprising: a main case; a switching mechanism accommodated in the main case, and having a mechanical part for opening and closing a circuit; a trip mechanism configured to trigger the switching mechanism to an interrupting position upon detection of an abnormal current on a circuit; and an external device detachably mounted to the main case, wherein the circuit breaker has an interrupting means configured to interrupt the switching mechanism by contacting at least a part of the external device when the external device is mounted to the main case.

The interrupting means may be configured to forcibly interrupt the switching mechanism by contacting a part of the external device when the external device is mounted to the main case.

The circuit breaker may further comprise a latch included in the switching mechanism, and configured to maintain a circuit connected state; a latch holder configured to restrict or release a movement of the latch; and a bracket rotatably mounted to the trip mechanism, and configured to restrict or release the latch holder according to a rotation direction.

The interrupting means may include a protrusion portion integrally formed at the bracket, and an arm formed at the external device.

The protrusion portion may be configured to rotate the bracket in a releasing direction by contacting the arm when the external device approaches to a mounting position of the main case, and configured not to contact the arm when the external device has been disposed at the mounting position.

The mounting position may mean a position of the external device having been completely coupled to the main case.

The protrusion portion may protrude from one side of the bracket.

The arm may be formed on a side surface of the external device. When the external device has been disposed at the mounting position, the arm may be disposed below the protrusion portion.

The protrusion portion may upward extend from one side of the bracket in a slant manner.

The present disclosure may have the following advantages.

Even if the external device is coupled to the circuit breaker in an 'on' state of the circuit breaker by a user's mistake, the circuit breaker may be automatically turned off. This may prevent the occurrence of accidents, and mechanical damages of components such as the bracket may be prevented.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of the exemplary embodiments, with reference to the accompanying drawings. For the sake of brief description with reference to the drawings, the same or equivalent components will be provided with the same reference numbers, and description thereof will not be repeated.

Figure 1:
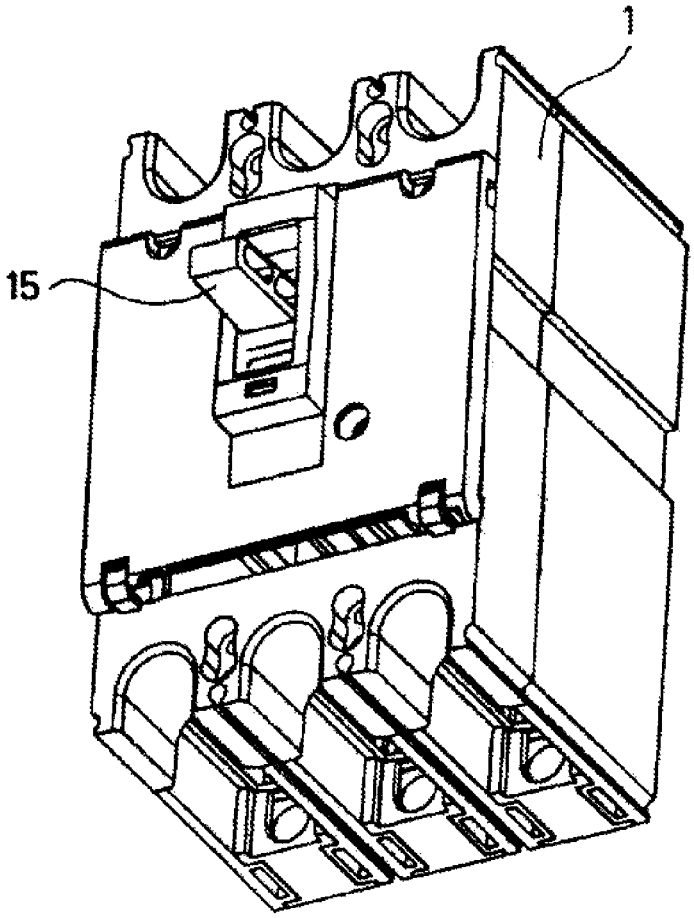
FIG. 1 CONVENTIONAL ART
FIG. 1 is a perspective view of a circuit breaker in accordance with the conventional art.
Figure 2:
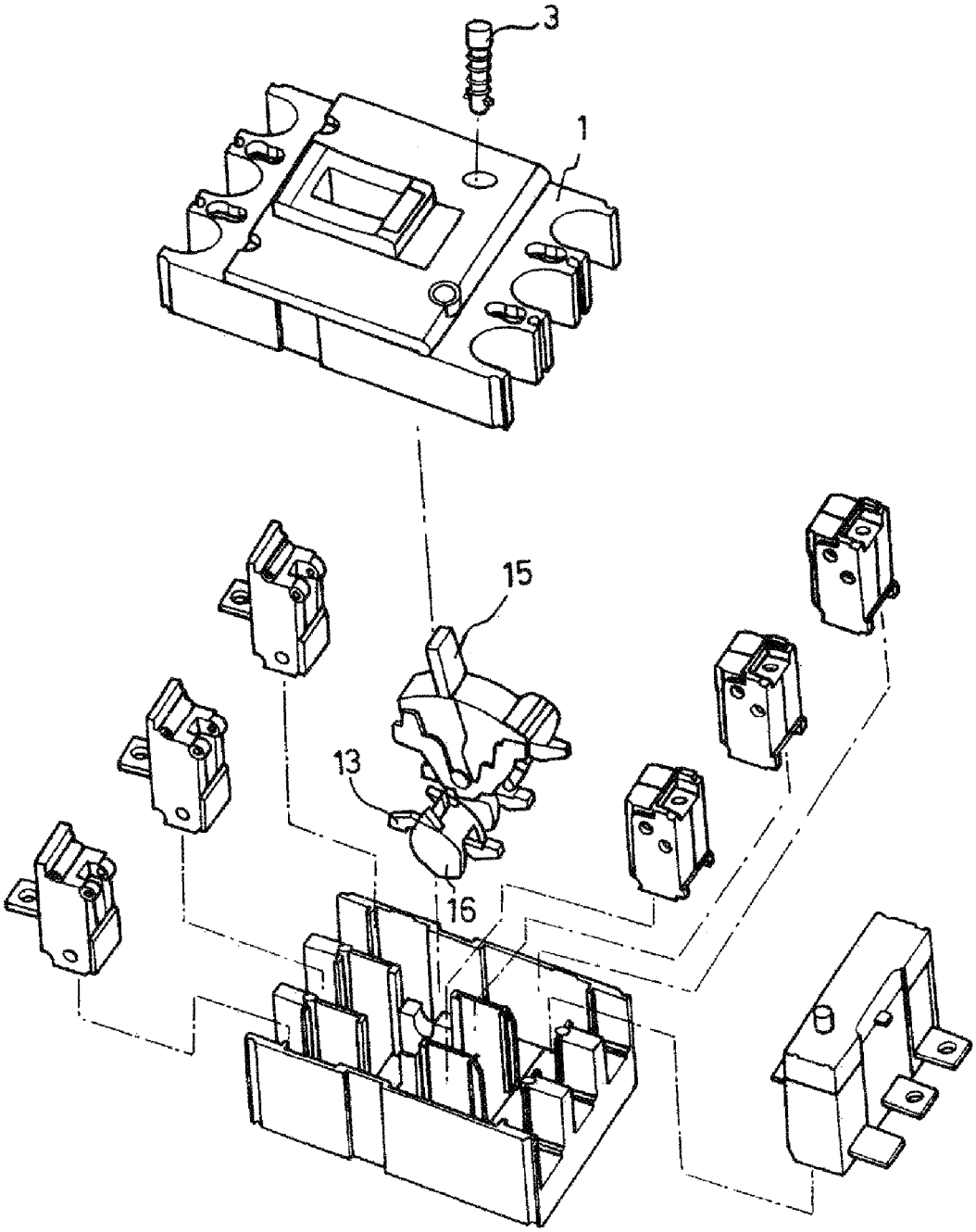
FIG. 2 CONVENTIONAL ART
FIG. 2 is a disassembled perspective view of the circuit beaker FIG. 1.
Figure 3:
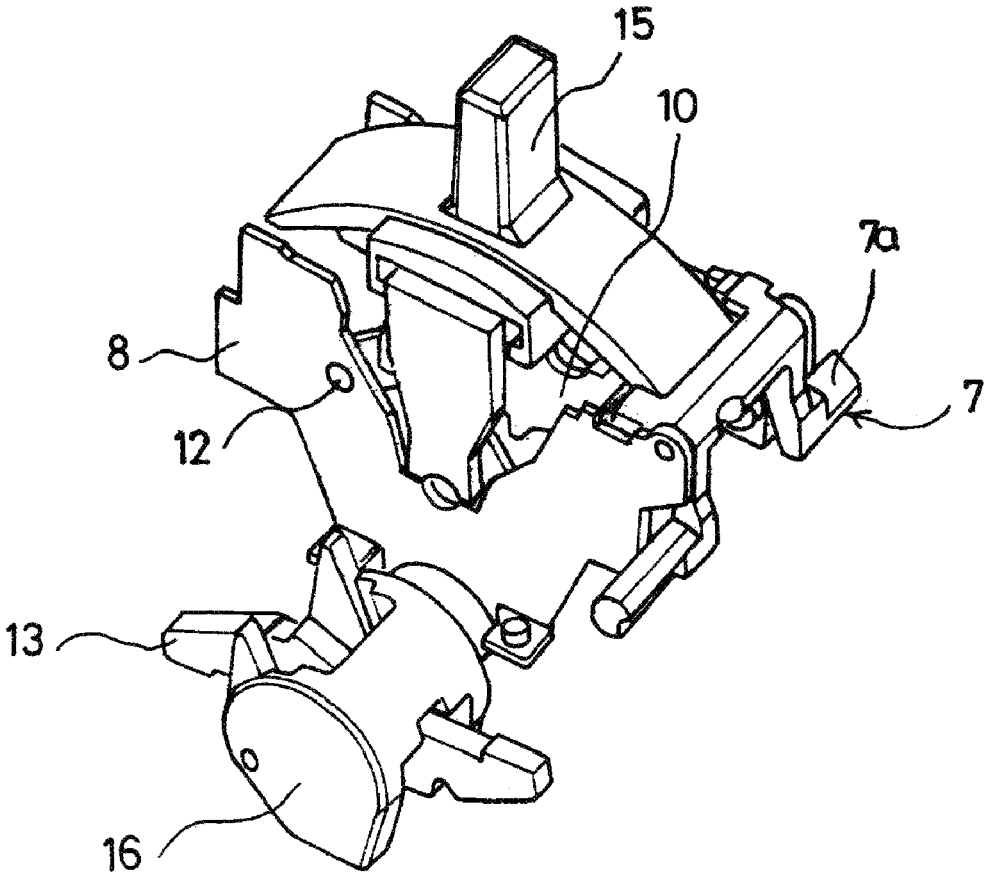
FIG. 3 CONVENTIONAL ART
FIG. 3 is an enlargement view of a switching mechanism of FIG. 2.
Figure 4A:
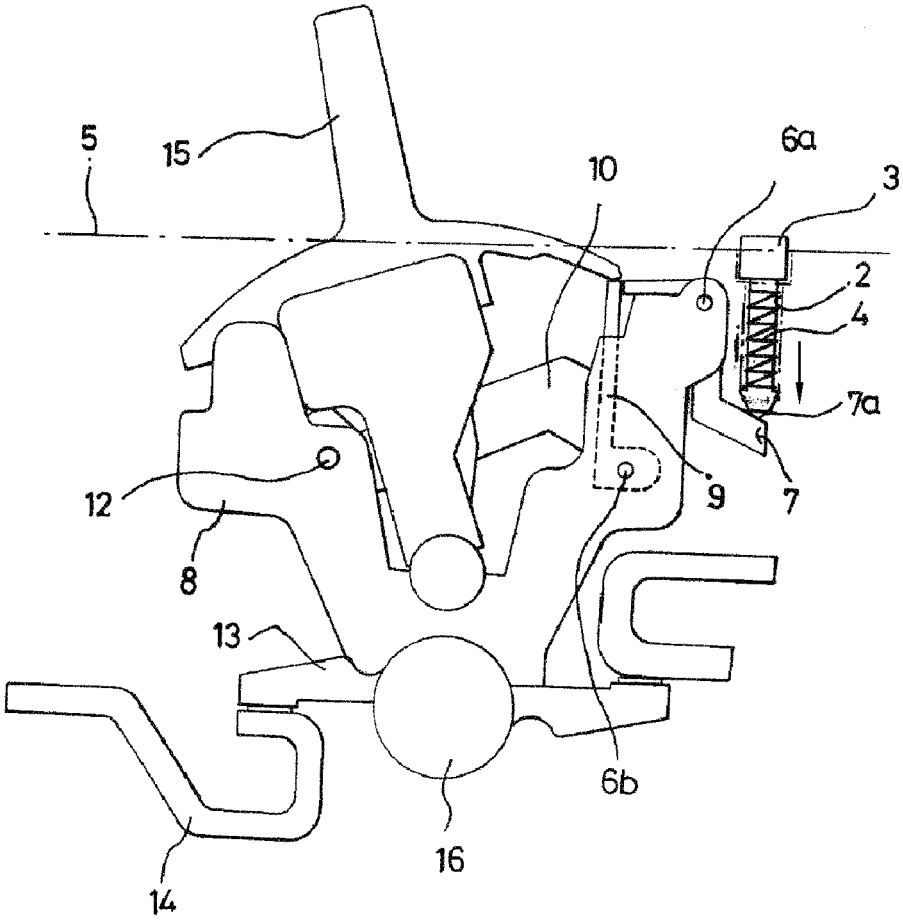
FIG. 4A CONVENTIONAL ART
FIG. 4A is a schematic view showing a state of the circuit breaker of FIG. 1 before a trip button has downward moved.
Figure 4B:
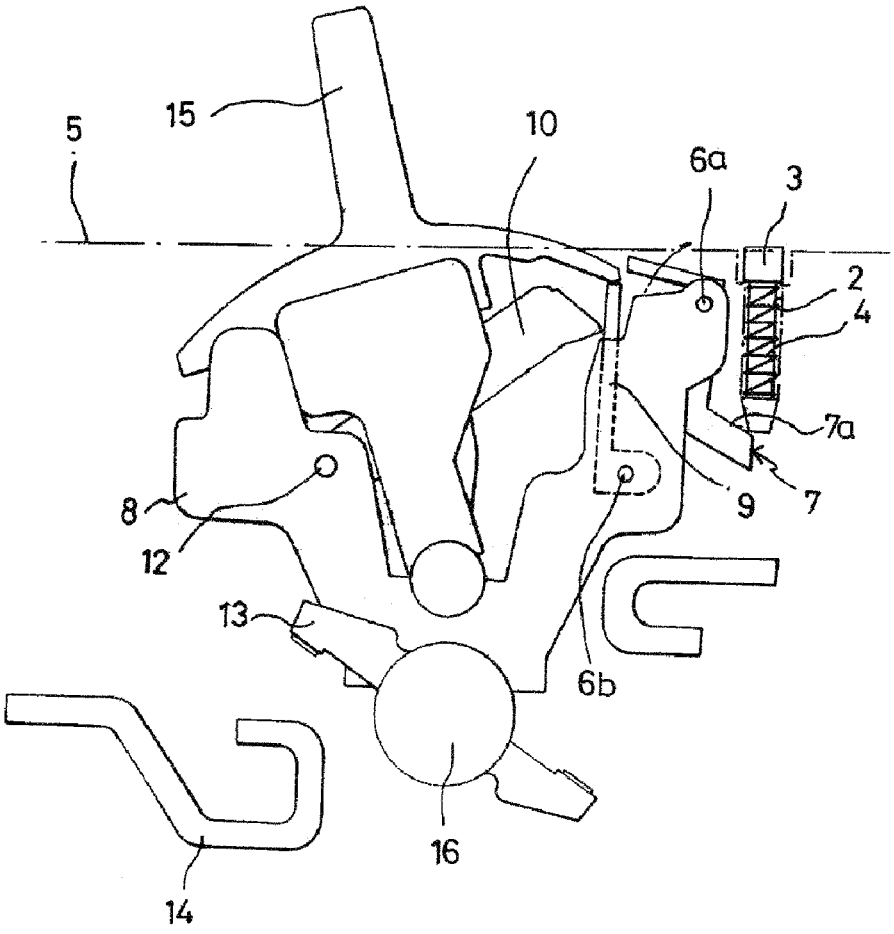
FIG. 4B CONVENTIONAL ART
FIG. 4B is a schematic view showing a state of the circuit breaker of FIG. 1 after a trip button has downward moved.
Figure 5:
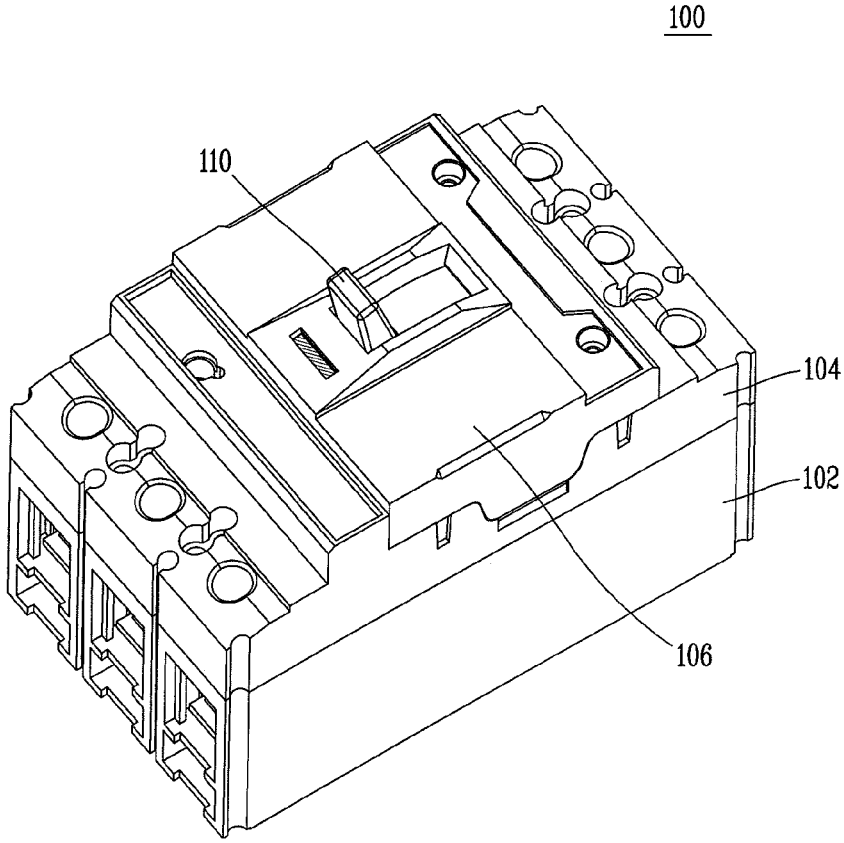
FIG. 5 is a perspective view of a circuit breaker according to an embodiment of the present disclosure.
Figure 6:
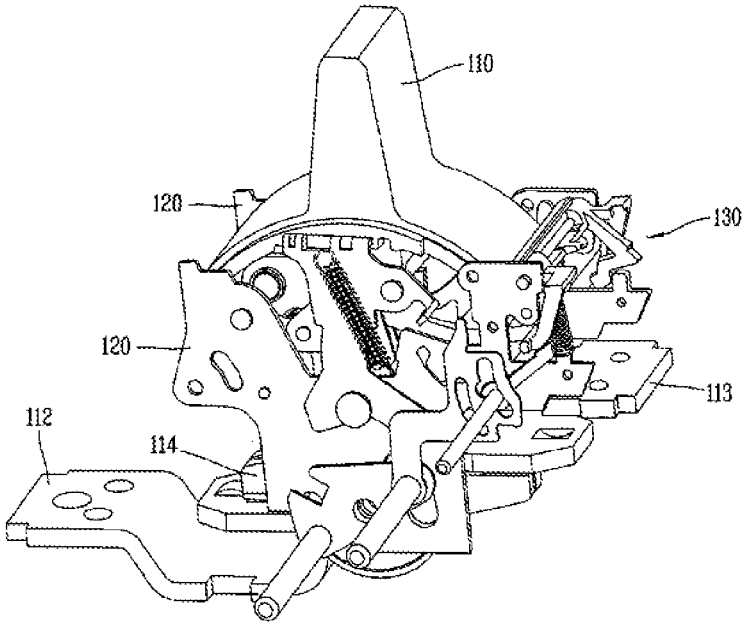
FIG. 6 is an enlarged perspective view of a trip mechanism of FIG. 5.

FIG. 5 is a perspective view of a circuit breaker according to an embodiment of the present disclosure, and FIG. 6 is a perspective view showing an inner structure of the circuit breaker of FIG. 5.

Referring to FIGS. 5 and 6, the circuit breaker 100 according to the present disclosure comprises a main case 102 having a rectangular shape, and a cover 104 configured to cover the main case 102. The cover 104 is installed with an auxiliary cover 106 removed when an external device is mounted to the circuit breaker 100.

Between the auxiliary covers 106, a handle 110 is provided to allow a user to manipulate the circuit breaker therethrough. A pair of fixed contactors 112 and 113 are disposed below the handle 110. A movable contactor 114 is provided so as to be movable to a position for contacting the fixed contactor, or to a position for being separated from the fixed contactor. The movable contactor 114 performs a trip operation by a trip mechanism. An operation of the trip mechanism is well-known, and thus its detailed explanations will be omitted.

A pair of side plates 120 are disposed at right and left sides of the handle 110, and serve as a base for supporting each component of the trip mechanism. At a rear side of the side plate 120 (right side in FIG. 5), a bracket 130 is mounted so as to be rotatable with respect to the side plate 120. The bracket 130 is disposed to restrict rotation of a latch disposed therebelow. Under this configuration, the movable contactor comes in contact with or is separated from the fixed contactor while rotating.

The bracket 130 includes a hinge shaft 132 fixed to the side plate 120, and first and second arms 134 and 136 which extend from two ends of the hinge shaft 132, respectively. A protrusion portion 138 which upward extends in a slant manner is formed on a side surface of the end of the first arm 134. The protrusion portion 138 interworks with an arm formed on a side surface of an external device, thereby rotating the bracket 130 and thus turning off the circuit breaker.

Figure 7:
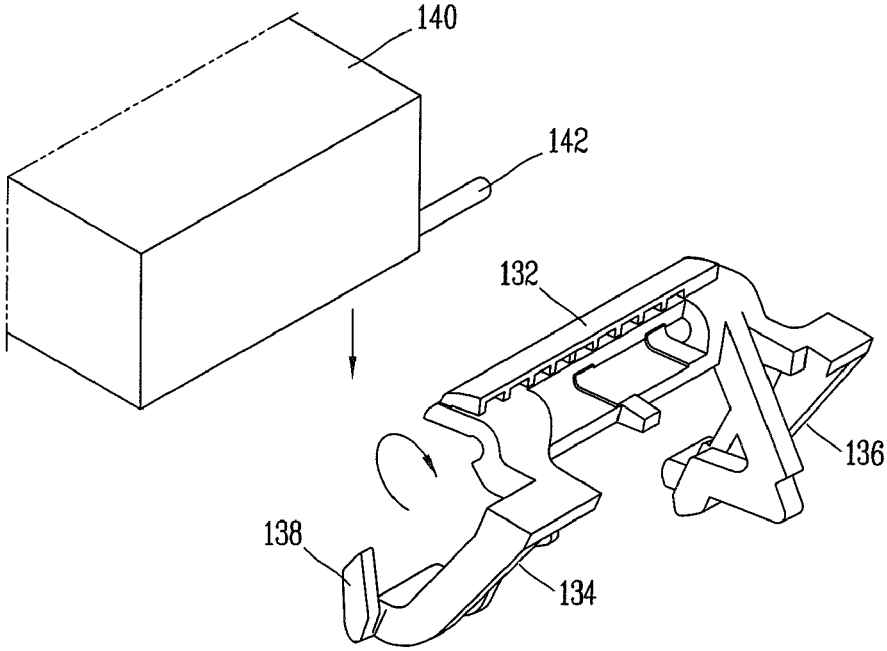
FIGS. 7 and 8 are perspective views schematically showing an operation of the circuit breaker of FIG. 5.
Figure 8:
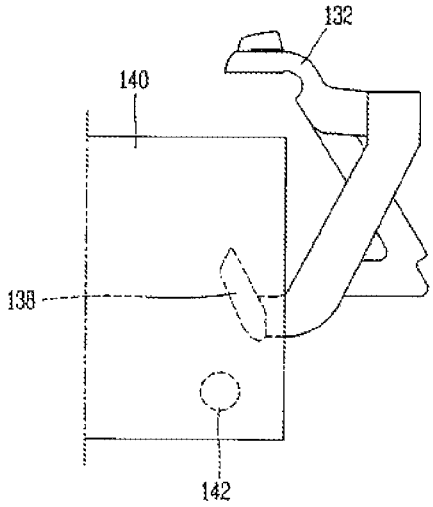

FIG. 7 is a view schematically showing a state that an external device 140 is being mounted to the circuit breaker.

Referring to FIG. 7, an arm 142 protrudes from a side surface of the external device 140 toward the protrusion portion 138. When viewed from the upside, the arm 142 extends to cross the protrusion portion 138.

As shown in FIG. 7, the external device 140 is downward inserted into the main case. During this process, the arm 142 may contact an upper surface of the protrusion portion 138. Once the external device 140 is more inserted into a mounting position, the arm 142 presses the protrusion portion 138. As a result, the bracket 130 is clockwise rotated about the hinge shaft 132 (in the direction indicated by the arrow in FIG. 7).

More concretely, since an upper surface of the protrusion portion 138 is formed as an inclination surface, the arm 142 is slide along the inclination surface. As a result, the bracket 130 is counterclockwise rotated to release the latch and to turn off the circuit breaker. Then, once the external device is disposed at the mounting position, the arm 142 passes through a rear end of the upper surface of the protrusion portion 138. As a result, the contacted state between the arm and the protrusion portion is released, and thus the bracket 130 returns to the original position.

In the case that the external device is disposed at the mounting position, the arm 142 is disposed below the protrusion portion 138. This may prevent a contact between the protrusion portion and the arm even if the bracket rotates.

In the present disclosure, even if the external device is coupled to the circuit breaker in an 'on' state of the circuit breaker by a user's mistake, the circuit breaker is turned off by the bracket due to a reciprocal operation between the arm and the protrusion portion. This may prevent the occurrence of accidents, and minimize damages of the bracket.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A circuit breaker, comprising:

a main case;

a switching mechanism accommodated in the main case, and having a mechanical part for opening and closing a circuit;

a trip mechanism configured to trigger the switching mechanism to a circuit interrupting position upon detection of an abnormal current on a circuit;

an external device detachably mounted to the main case;

a latch included in the switching mechanism, and configured to maintain a circuit connected state;

a latch holder configured to restrict or release a movement of the latch; and a bracket rotatably mounted to the trip mechanism, and configured to restrict or release the latch holder according to a rotation direction, wherein the circuit breaker comprises an interrupting means configured to interrupt the switching mechanism by contacting at least a part of the external device when the external device is mounted to the main case, and wherein the interrupting means includes a protrusion portion integrally formed at the bracket, and an arm formed at the external device.

2. The circuit breaker of claim 1, wherein the protrusion portion is configured to rotate the bracket in a releasing direction by contacting the arm when the external device approaches to a mounting position of the main case, and configured not to contact the arm when the external device has been disposed at the mounting position.

3. The circuit breaker of claim 1, wherein the protrusion portion protrudes from one side of the bracket.

4. The circuit breaker of claim 3, wherein the arm is formed on a side surface of the external device, and wherein when the external device has been disposed at the mounting position, the arm is disposed below the protrusion portion.

5. The circuit breaker of claim 3, wherein the protrusion portion upward extends from one side of the bracket in a slant manner.

* * * * *